US006261328B1

(12) United States Patent
Champagne

(10) Patent No.: US 6,261,328 B1
(45) Date of Patent: Jul. 17, 2001

(54) DIMENSIONALLY STABLE ABRASIVE DISCS

(75) Inventor: Paul J. Champagne, Mechanicville, NY (US)

(73) Assignee: Norton Company, Worcester, MA (US)

( * ) Notice: Subject to any disclaimer, the term of this patent is extended or adjusted under 35 U.S.C. 154(b) by 0 days.

(21) Appl. No.: 09/504,671

(22) Filed: Feb. 15, 2000

(51) Int. Cl.[7] ..... B24D 11/00; B24D 11/02

(52) U.S. Cl. ..... 51/297; 51/295; 51/294; 451/532; 451/533

(58) Field of Search ..... 51/294, 295, 297, 51/293, 307, 309; 451/532, 533

(56) References Cited

U.S. PATENT DOCUMENTS 5,582,625 * 12/1996 Wright et al. ..... 51/294
5,609,706 * 3/1997 Benedict et al. ..... 451/536
6,066,188 * 5/2000 Benedict et al. ..... 51/295

* cited by examiner

*Primary Examiner*—Michael Marcheschi
(74) *Attorney, Agent, or Firm*—David Bennett

(57) ABSTRACT

This invention describes a method of making abrasive products such as discs with enhanced resistance to deformation as a result of the influence of moisture by laminating a coated abrasive having a fibrous backing lacking dimensional stability when exposed to humidity to a secondary backing comprising an isotropic mat of fibers in a matrix of a polymer.

3 Claims, No Drawings

DIMENSIONALLY STABLE ABRASIVE DISCS

BACKGROUND OF THE INVENTION

This invention relates to abrasive products with improved dimensional stability and particularly to fiber-backed abrasive discs.

In a conventional process for producing abrasive discs for general purpose abrading, a backing material that has been treated with a maker adhesive layer on a major surface is coated over the maker coat with abrasive grain and the coat is at least partially cured to adhere the grain to the coat. A size coat is then deposited over the grain to secure the grain in place and the size coat is cured. The backing material is usually in form of a large roll, called a "jumbo", such that the initial form of the abrasive material is a jumbo and this is given any necessary final cure while in the rolled position.

The maker and size coats are conventionally supplied by phenolic resins which require a protracted cure period, a portion of which is most frequently conducted while the material is in the jumbo form. When abrasive discs are the target product, the jumbo is unrolled and discs are cut from the roll. Not surprisingly the discs often have a slight curvature from the final cure that occurred in the jumbo. More importantly, when the backing is a fibrous material, such as a woven or stitch-bonded fabric or a cellulosic material, this is often sensitive to water content and changes in the moisture content of the surroundings, whether during manufacture of the discs or use of the finished item, can lead to the development of a distinct curl to the disc. Curling is usually caused by a mis-match of dimensional changes between the backing and the maker/grain layer when exposed to ambient moisture variations between the time the product was manufactured and when it is shipped to the final destination and unpacked for use by the customer. Usually the curling is more pronounced in the machine direction and this is attributed to anisotropic dimensional changes in the fiber backing. Attempts have been made to remedy this problem by controlling moisture content and degree of flexing. However curling will still occur as the discs are exposed to widely varying humidity conditions in different geographical locations.

There is therefore a need for a process that will produce dimensionally stable abrasive materials such as discs, wherein the stability is essentially independent of the relative humidity at the time of manufacture and use.

DESCRIPTION OF THE INVENTION

The present invention provides a process for the production of dimensionally stable abrasive sheet materials which comprises laminating a sheet of an abrasive material comprising abrasive grain adhered to a major surface of a fibrous backing material to a sheet of a secondary backing material that is isotropic in the plane of the sheet and comprises a fibrous material and a polymeric material in a polymer to fiber volume ratio of from 1:3 to 30:1. The secondary backing with such a structure has sufficient rigidity and dimensional stability to overcome any stresses imposed on the combined structure by any of the forces discussed above that typically lead to curling.

Because the secondary backing sheet is applied after the abrasive sheet material is formed it can be designed with the specific application in mind and to some extent tailored appropriately. As an example if the finished product is a disc intended to be used with a rotary grinder tool and attached thereto by a paired hook and loop attachment mechanism, the appropriate component of the pair can be attached to the secondary backing sheet opposed to that laminated to the abrasive material. Equally if the attachment means were a pressure sensitive adhesive, (PSA), the secondary backing material could comprise a sheet with one major surface provided with a PSA covered by a release film.

Equally if the application is one in which a heavy duty abrasive operation is required, a more robust secondary backing material may be provided than would be required if the application is one in which less pressure will be applied during grinding. Thus the process of the invention provides a high level of flexibility in production wherein any jumbo in which an abrasive grain of a given grit size has been incorporated can be used to produce a range of dimensionally stable products distinguished by the nature of the sheet of secondary backing material laminated thereto.

A further significant advantage of the present invention is that lighter weight materials can be used to provide the backing to which the abrasive grains are adhered since the necessary level of dimensional stability and physical integrity can be supplied by the secondary backing material. Thus the number of different types of jumbo that will need to be produced and stored can be significantly reduced and the required product can be made to order, thereby reducing the need for extensive inventory in all the product lines offered.

DESCRIPTION OF PREFERRED EMBODIMENTS

The abrasive-bearing sheet and the secondary backing material can be laminated by any appropriate technique including application, to one or both of the surfaces to be adhered, of a curable adhesive that is compatible with both sheets to be laminated. Of course a pressure sensitive adhesive can also be used. It is also possible, where the polymer component of the secondary backing material is a thermoplastic resin to simply heat-soften the resin and contact the materials to be laminated under pressure to allow the resin component to penetrate the fibrous backing of the abrasive sheet material before it hardens again.

The secondary backing material can be selected from materials such as those described in U.S. Pat. No. 5,582,625 which describes the use of a backing material comprising a staple fiber mat bonded by a thermoset resin with the resin and fibers present in a volume ratio of from 1:3 to 30:1 that is isotropic in the plane of the backing.

The secondary backing material can also have a similar structure to that described above with the resin being a thermoplastic resin providing this has sufficient heat resistance to withstand normal temperatures encountered during the grinding or lamination processes. Typical products of this sort are described in U.S. Pat. No. 5,417,726 for example and the contents of both U.S. Pat. Nos. 5,582,625 and 5,417,726 are incorporated herein by reference.

The fibers from which the mat incorporated in the backing may be formed can be staple fibers or spun-bonded or tangled continuous crimped or un-crimped filaments. These may be of nylon, polyester, polyolefins, carbon, glass as well as mixtures of such fibers. The resin matrix in which the resin mat is disposed can be a polyurethane, a polyesterurethane, an epoxy resin, unsaturated or saturated polyester, phenolic resin, polyolefin, a radiation curable resin such as an acrylate-based resin as well as mixtures of such resins. The relatively high proportion of resin ensures that the secondary backing material has a high degree of resistance to curling and the effects of moisture. At the same time the random orientation of the fibers ensures that the backing has isotropic properties in the plane of the backing.

The primary backing upon which the abrasive grains are deposited can be of any desired fibrous material such as paper or woven, non-woven or knitted fabric. However in order to secure the greatest versatility for the product it is preferred that the backing is a woven cellulosic fabric and preferably one that has received a conventional front and optionally also a back size treatment to limit its porosity and capacity to absorb a maker coat deposited thereon and to improve the rheology of the material. Clearly if adhesion to the secondary backing material is to be enhance by penetration of the binding agent into the primary backing material, any back size applied should preferably not be such as would preclude this possibility.

The abrasive grit can be any conventionally used in coated abrasive products including fused and sintered alumina, silicon carbide and alumina/zirconia The grit sizes are typically from about 16 to 400 grit with the most commonly used grit sizes for abrasive discs being from about 24 to 220 grit.

The coated abrasive made in the manner described in this Application are preferably abrasive discs where the property of curl resistance is most important. However if a belt is to be made from a jumbo using the process of the invention, the secondary backing can be designed with the flexibility usually required for such a belt in mind rather than the curl resistance. Thus the process of the invention is extremely flexible with the same coated abrasive sheet being adapted for different end purposes with specific desired properties by selection of an appropriate secondary backing.

What is claimed is:

1. A process for the production of dimensionally stable abrasive sheet materials which comprises laminating a sheet of an abrasive material comprising abrasive grain adhered to a major surface of a fibrous backing material to a sheet of a secondary backing material that is isotropic in the plane of the sheet and comprises a fibrous material and a polymeric material in a polymer to fiber volume ratio of from 1:3 to 30:1.

2. A process according to claim 1 in which the laminated sheet material is thereafter converted to abrasive discs.

3. A process according to claim 1 in which the polymeric material is phenolic resin.

* * * * *